US006052956A

United States Patent [19]

Hoy et al.

[11] Patent Number: 6,052,956

[45] Date of Patent: Apr. 25, 2000

[54] SKYLIGHT ASSEMBLY

[75] Inventors: Walter S. Hoy; W. Douglas Hoy, both of Huber Heights, Ohio

[73] Assignee: Fox Lite, Inc., Fairborn, Ohio

[21] Appl. No.: 09/002,435

[22] Filed: Jan. 2, 1998

Related U.S. Application Data

[60] Provisional application No. 60/034,175, Jan. 2, 1997.

[51] Int. Cl.[7] ..... E04B 7/18; E04D 13/03

[52] U.S. Cl. ..... 52/200; 52/58

[58] Field of Search ..... 52/200, 58

[56] References Cited

U.S. PATENT DOCUMENTS

| | | | |
|---|---|---|---|
| 2,918,023 | 12/1959 | Bettcher | 52/200 X |
| 3,127,699 | 4/1964 | Wasserman | 52/200 X |
| 3,350,823 | 11/1967 | Murray | 52/200 |
| 4,296,578 | 10/1981 | Keckman | 52/200 |
| 4,344,261 | 8/1982 | Weisner et al. | 52/200 |
| 4,548,006 | 10/1985 | Roberts, Sr. . | |
| 4,549,379 | 10/1985 | Hoy et al. . | |
| 4,776,141 | 10/1988 | Powell | 52/200 |
| 4,823,525 | 4/1989 | Roberts et al. . | |
| 4,896,468 | 1/1990 | Sampson | 52/200 |
| 4,972,638 | 11/1990 | Minter | 52/200 |
| 5,062,247 | 11/1991 | Dittmer | 52/200 |
| 5,299,396 | 4/1994 | Raap et al. | 52/200 X |

FOREIGN PATENT DOCUMENTS

| | | | |
|---|---|---|---|
| 689527 | 6/1964 | Canada | 52/200 |
| 35133 | 7/1965 | Finland | 52/200 |
| 315248 | 8/1956 | Switzerland | 52/200 |

OTHER PUBLICATIONS

"Consolite, Easier to Install on any Roof", Consolidated General Products, Inc., Architectural Record, p. 63, Jan. 1956.

*Primary Examiner*—Laura A. Callo
*Attorney, Agent, or Firm*—Jacox, Meckstroth & Jenkins

[57] ABSTRACT

A sheet of light transmitting polycarbonate is vacuum-formed to produce a lower skylight glazing or pane, a surrounding curb portion and a surrounding flange or flashing portion projecting outwardly from the curb portion. The curb portion has a peripheral rim surface and a lower step surface, and an upper pane of glass or plastic has a peripheral portion sealed to the rim surface. Additional panes of plastic sheets may be sealed to the peripheral portion of the upper pane and to the step surface to provide increased thermal insulation. Parallel ribs are formed in the flashing portion, and strips of rigid plastic insulation foam and wood trim are bonded by adhesive to each other and to the inner surfaces of the curb portion.

9 Claims, 2 Drawing Sheets

SKYLIGHT ASSEMBLY

RELATED APPLICATION

This application claims the benefit of provisional application Ser. No. 60/034,175, filed Jan. 2, 1997.

BACKGROUND OF THE INVENTION

This invention relates to skylights, for example, of the general type disclosed in U.S. Pat. No. 4,548,006, No. 4,549,379 and No. 4,823,525 which are owned by the assignee of the present invention, and the disclosures of which are incorporated by reference. In such skylights, it is common to construct a wood rectangular frame-like curb which projects upwardly from a sloping roof deck. The curb may also be constructed by vacuum-forming a sheet of thermoplastics material with an outwardly projecting integral peripheral flange or flashing portion, such as disclosed in connection with FIG. 3 of above U.S. Pat. No. 4,549,379. A skylight unit is mounted on the curb and commonly includes one or more spaced flat panes of glass surrounded by a rectangular aluminum trim frame, and sealant strips are used between the lower glass pane and the supporting surface of the curb and also between the glass panes and the surrounding trim frame. The skylight unit may also be constructed of one or more panes of transparent plastics material, and the panes may be dome-shaped with the upper or outer pane including an integral depending skirt which surrounds the curb unit, as also disclosed in above U.S. Pat. No. 4,549,379.

SUMMARY OF THE INVENTION

The present invention is directed to an improved skylight assembly which is leakproof and provides for different levels of thermal insulation in addition to being easy to install on a roof deck of a building after an opening is cut or formed within a roof deck. The skylight assembly of the invention also provides for the optional use of step flashing and eliminates any joints or connections where air or moisture may seep from the outside into the room below the skylight.

In accordance with a preferred embodiment of the invention, a sheet of transparent plastic material, such as polycarbonate, is vacuum-formed to provide an inner pane or glazing and a surrounding planar flange or flashing which are integrally connected by curb portion of the sheet. The curb portion has a stepped cross-sectional configuration and provides for supporting either a glass top pane or glazing or one or more sheets of transparent plastics material which may be vacuum-formed to define a plurality of sealed air chambers between the sheets.

An extruded aluminum trim strip surrounds the curb portion of the vacuum-formed inner sheet and outer peripheral edge portions of the glazing sheets. Strips of rigid foam insulation material are bonded to the inner surfaces of the curb portion, and inner wood trim strips are bonded to the foam insulation strips. The upper edge surfaces of the wood trim strips are attached by sealant strips to the step portion of the inner sheet, and strips of adhesive sealant material bond the step portion of the inner sheet to the glazing sheets. The inner wood trim strips are also provided with grooves for receiving sheets of drywall which define the view opening for the skylight assembly.

Other features and advantages of the invention will be apparent from the following description, the accompanying drawings and the appended claims.

DESCRIPTION OF THE PREFERRED EMBODIMENTS

Figure 1:
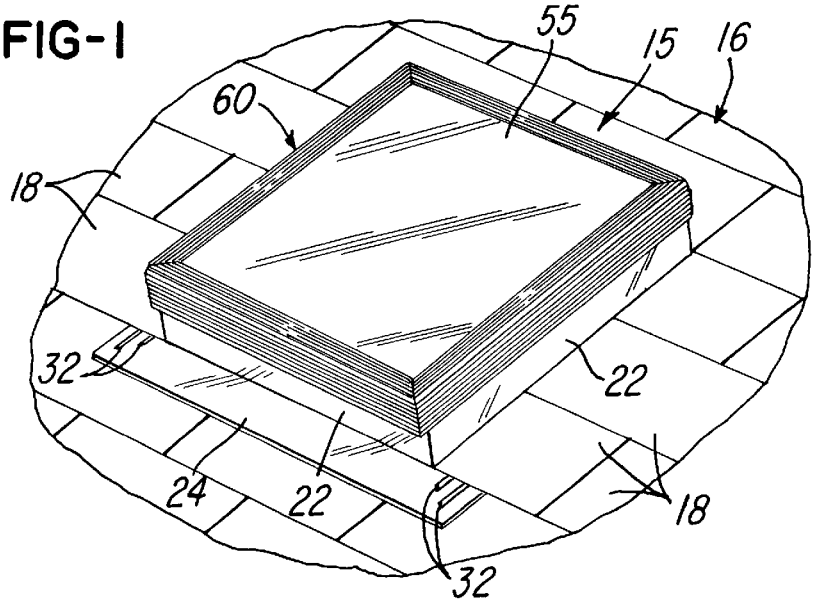
FIG. 1 is a perspective view of a skylight unit or assembly constructed in accordance with the invention and illustrating the assembly installed on a sloping roof.

A skylight unit or assembly 15 is mounted within a sloping roof 16 having a covering of shingles 18, and includes a thermoformed or vacuum-formed sheet 19 of transparent plastics material, preferably polycarbonate. The sheet 19 forms a curved lower or inner skylight pane or glazing 20 (FIG. 2) which is surrounded by an upwardly projecting integral curb portion 22 also formed from the sheet. The transparent sheet 19 further extends to form an integral surrounding planar flange or flashing portion 24 which has peripherally spaced or corner holes 26 for nailing the flashing portion 24 directly to a wood roof deck 28 (FIG. 3). A set of parallel spaced anti-syphon ribs 32 are also vacuum-formed within the flashing portion 24 along the sides and top of the flashing portion and extend to the bottom panel of the flashing portion 24, as shown in FIG. 1.

A set of strips 34 of rigid foam insulation material are adhesively attached to the inner peripheral surfaces of the curb portion 22, and wood trim strips or boards 36 are adhesively attached to the inner peripheral surfaces of the foam strips 34. Flat strips 38 of adhesive sealant are mounted on the top surfaces of the frame-like wood trim boards 36 and support an intermediate step portion 42 of the transparent plastic sheet 19 which forms the inner pane or glazing 20 and the curb portion 22. Another set of flat strips 44 of the adhesive sealant may also attach the step portion 42 to the peripheral portion of an optional flat intermediate pane or glazing 45 of transparent plastics material. A notch or recess 48 is formed within the bottom surface of each wood trim strip 36 for receiving a drywall sheet 51 (FIG. 3) which is secured to the adjacent roof truss member 52 supporting the roof deck 28.

Figure 2:
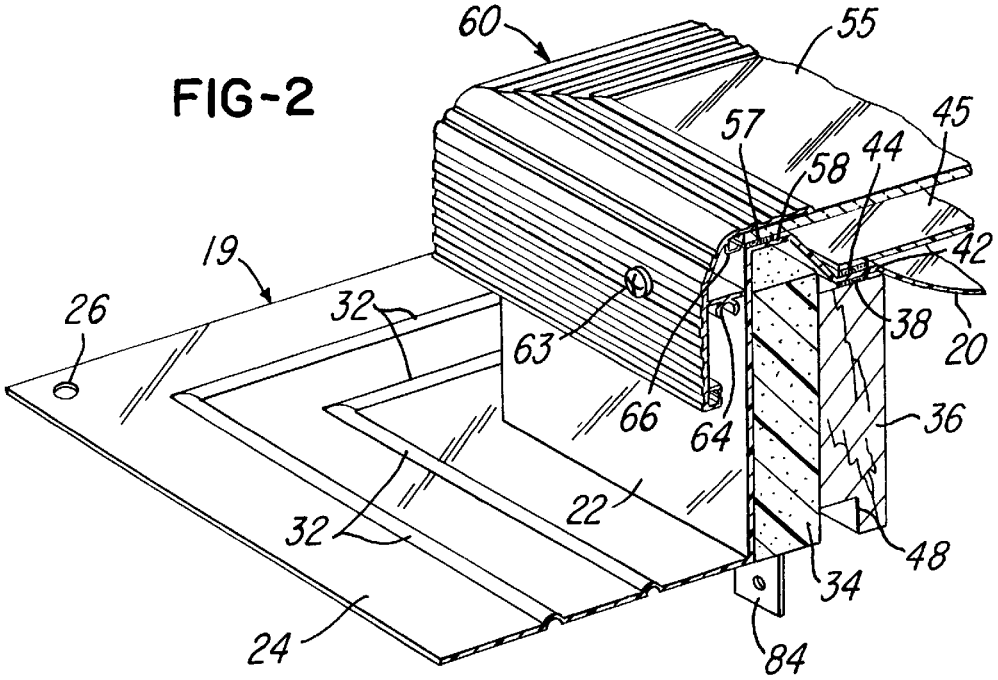
FIG. 2 is an enlarged fragmentary perspective view of an upper corner portion of the skylight assembly shown in FIG. 1.
Figure 3:
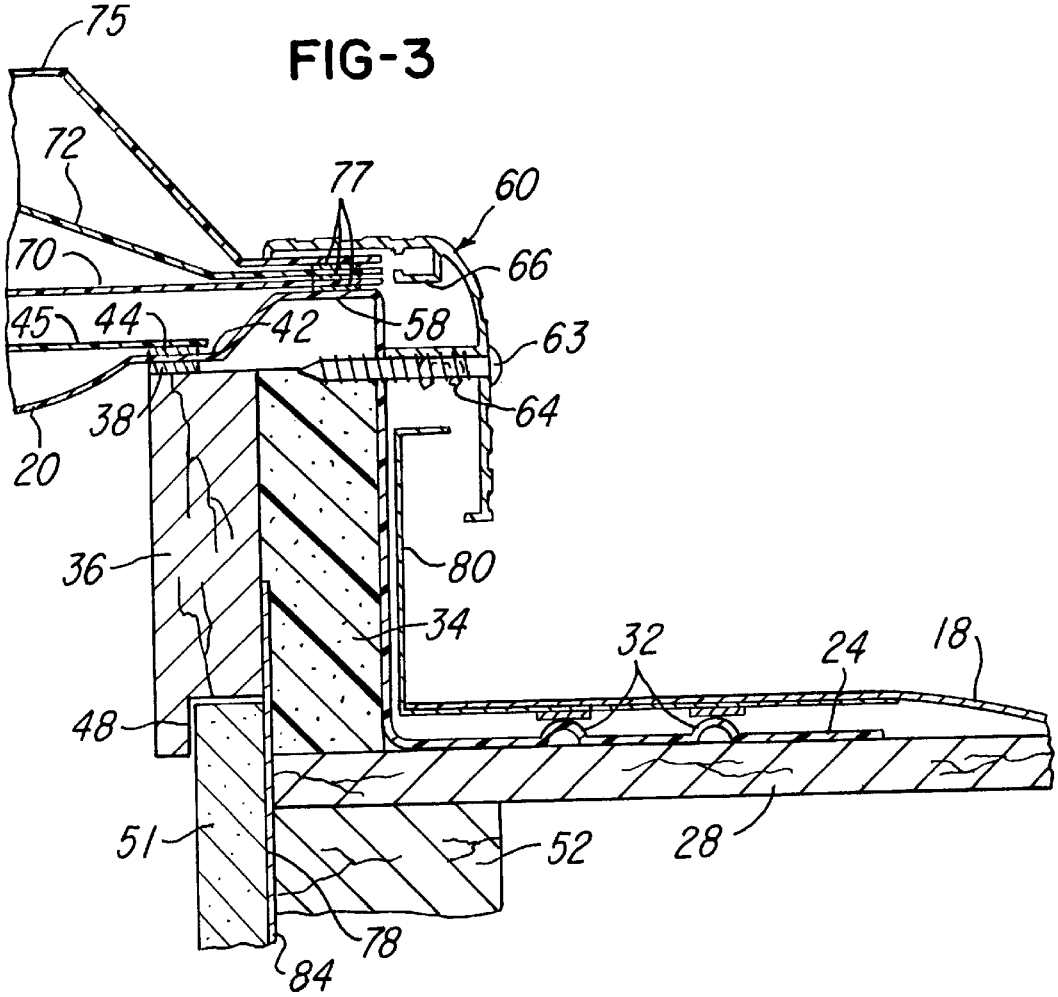
FIG. 3 is a fragmentary section of a similar skylight assembly constructed in accordance with a modification of the invention.

Referring to FIG. 2, a top transparent glass panel or glazing pane 55 has a peripheral edge portion attached by a flat strip 57 of sealant material, such as silicone or butyl, to the upper rim surface 58 of the curb portion 22. A rectangular metal trim ring or frame 60 surrounds the glass pane 55 and is preferably constructed of extruded aluminum strips having mitered corners. The mitered ends of the aluminum strips are connected together by screws 63 which are threaded into C-shaped portions 64 extruded as integral parts of the trim strips. The extruded aluminum strips also include inner corner channel portions 66 which receive L-shaped corner keys (not shown) for securing the mitered corners of the frame 60 together.

The thermal insulation provided by the trapped air between the inner plastic pane 20, the outer glass pane 55 and the optional intermediate plastic pane 45, may be increased by replacing the flat glass pane 55 with two or more panes of plastic transparent material such as a flat plastic pane 70 (FIG. 3), a dome-shaped pane 72 and an emerald-shaped outer pane 75. The peripheral edge portions of the panes 70, 72 and 75 are sealed together by additional flat strips 77 of sealant material such as silicone or butyl.

The skylight assembly or unit shown in either FIG. 2 or FIG. 3 is adapted for convenient and quick installation after cutting a rectangular opening 78 within the roof deck 28. After the skylight unit or assembly is positioned as shown in FIG. 3, the flange or flashing 24 is nailed to the roof deck 28 with nails extending through the peripherally spaced holes 26. The shingles 18 may then be installed directly over the peripheral flashing 24 or, if desired, aluminum step flashing 80 may be installed along the sloping sides of the skylight assembly 15 with a continuous aluminum flashing overlying the top portion of the flashing 24. If any water seeps around the shingles onto the continuous top flashing or the step flashing 80, the water is directed down the flashing 24 within the channels defined by the ribs 32 and drains onto the roof shingles 18 underlying the flashing 24 at the bottom of the skylight, as shown in FIG. 1. A series of peripherally spaced hold down straps 84 (FIGS. 2 & 3) are preferably attached to the outer surfaces of the wood trip strips 36 and are secured by nails to the roof trusses 52 before the drywall sheets 51 are installed, to secure the skylight assembly 15 to the roof deck 28.

It is apparent that the one-piece vacuum-formed transparent sheet 19 which forms the inner pane 20 and the integrally connected curb portion 22 and flashing 24, has no joints or connections. This one-piece unit prevents any leakage through or around the skylight into the room below. The glass pane 55 and the optional transparent plastic pane 45 provide for additional levels of thermal insulation, and the additional transparent plastic panes 70, 72 and 75 provide for even further thermal insulation by defining the dead air spaces or chambers between the panes.

The skylight assembly of the invention also adds safety to a skylight with a glass exterior pane 55. That is, the essentially unbreakable inner plastic or polycarbonate pane 20 will not allow any broken glass to fall into the occupied area of the building. This is a great advantage in locations where a skylight could be broken by golf balls, baseballs, hail or other falling or flying objects. The slot 48 in each wood trim 36 also provides for receiving the corresponding upper edge portion of drywall 51, and the insulation strips 34 minimize heat transfer from the curb portion 22 of the one-piece plastic sheet 19.

While the forms of skylight assembiles herein described constitute preferred embodiments of the invention, it is to be understood that the invention is not limited to these precise forms, and that changes may be made therein without departing from the scope and spirit of the invention as defined in the appended claims.

What is claimed is:

1. A skylight assembly comprising a formed single sheet of light transmitting plastics material forming a lower skylight pane, said sheet extending to form an upwardly projecting curb portion surrounding said lower pane and having a peripheral rim surface disposed above the entire said lower pane, said curb portion of said sheet having an outer wall projecting downwardly from said rim surface, said sheet further extending from said curb portion to form a substantially planar flashing portion projecting laterally outwardly from said outer wall of said curb portion and surrounding said curb portion, said sheet forming a one-piece jointless unit with said lower skylight pane integrally connected to said flashing portion by said curb portion, and an upper skylight pane of light transmitting material spaced above said lower pane and having a peripheral portion supported by said rim surface.

2. A skylight assembly as defined in claim 1 wherein said curb portion of said sheet forms a generally planar step surface surrounding said lower pane and disposed below said rim surface, and further comprising an intermediate skylight pane of light transmitting material, said intermediate skylight pane spaced between said upper and lower panes, and said intermediate pane having a peripheral portion attached to said step surface.

3. A skylight assembly as defined in claim 1 wherein said sheet also forms ribs having inverted U-shaped cross-section within said flashing portion of said sheet, and said ribs extend along at least two opposite side sections of said flashing portion.

4. A skylight assembly as defined in claim 3 wherein said ribs comprise parallel spaced ribs within each said side section of said flashing portion.

5. A skylight assembly as defined in claim 1 wherein said curb portion of said sheet has a stepped cross-sectional configuration and has a planar step surface surrounding said lower pane below said rim surface, strips of rigid material connected to said outer wall of said curb portion of said sheet by corresponding foam strips, and said strips have upper surfaces supporting said step surface of said curb portion of said sheet.

6. A skylight assembly comprising a vacuum-formed single sheet of light transmitting plastics material forming a lower skylight pane, said sheet extending to form an upwardly projecting generally rectangular curb portion surrounding said lower pane and having a peripheral upper rim surface disposed above the entire said lower pane, said curb portion of said sheet having an outer wall projecting downwardly from said rim surface, said sheet further extending from said curb portion to form a substantially planar and generally rectangular flashing portion projecting laterally outwardly from said outer wall said curb portion below said lower pane and surrounding said curb portion, said sheet forming a one-piece jointless unit with said lower skylight pane integrally connected to said flashing portion by said curb portion, and an upper skylight pane of light transmitting material spaced above said lower pane and having a peripheral portion supported by said upper rim surface.

7. A skylight assembly as defined in claim 6 wherein said curb portion of said sheet forms a generally planar step surface surrounding said lower pane and disposed below said rim surface, and further comprising an intermediate skylight pane of light transmitting material, said intermediate skylight pane spaced between said upper and lower panes, and said intermediate pane having a peripheral portion attached to said step surface.

8. A skylight assembly as defined in claim 6 wherein said sheet also forms ribs having inverted U-shaped cross-section within said flashing portion of said sheet, and said ribs extend around said curb portion.

9. A skylight assembly as defined in claim 8 wherein said ribs comprise parallel spaced ribs within a top section and opposite side sections of said flashing portion.

* * * * *